United States Patent [19]

Reinhardt

[11] 4,232,917

[45] Nov. 11, 1980

[54] COLLAPSIBLE COLUMN WITH COVERED TRAY

[76] Inventor: John H. Reinhardt, 1640 Braeburn Rd., Altadena, Calif. 91001

[21] Appl. No.: 971,809

[22] Filed: Dec. 21, 1978

[51] Int. Cl.[2] ..... F16M 11/00; B61G 3/00

[52] U.S. Cl. ..... 312/128; 312/284; 211/117; 248/409

[58] Field of Search ..... 312/128, 183, 42, 284; 248/409, 415, 579, 318; 211/115, 117; 292/278, 338, 339

[56] References Cited

U.S. PATENT DOCUMENTS

| | | | |
|---|---|---|---|
| 320,916 | 6/1885 | Dunlap | 248/415 |
| 493,111 | 3/1893 | Parsons | 248/409 |
| 675,861 | 6/1901 | Marquart | 211/115 |
| 1,178,343 | 4/1916 | Payne et al. | 211/117 |
| 1,858,595 | 5/1932 | Parker et al. | 211/117 |
| 1,940,770 | 12/1933 | Prater | 292/278 |
| 2,016,132 | 10/1935 | Bergslien | 248/409 |
| 2,398,602 | 4/1946 | Sibley et al. | 292/278 |
| 2,830,707 | 4/1958 | Schmidt et al. | 211/113 |
| 3,006,481 | 10/1961 | Gussack | 211/117 |
| 3,033,628 | 5/1962 | Hoffman | 211/117 |
| 3,711,021 | 1/1973 | Tantillo | 211/115 |
| 3,804,355 | 4/1974 | Uroshevich | 248/125 |

FOREIGN PATENT DOCUMENTS

| | | | |
|---|---|---|---|
| 818911 | 7/1969 | Canada | 248/415 |
| 452142 | 5/1968 | Switzerland | 248/409 |

*Primary Examiner*—Victor N. Sakran
*Attorney, Agent, or Firm*—Lyon & Lyon

[57] ABSTRACT

A tray for holding articles is attached to a collapsible column such that the tray may be suspended such as from a ceiling or other surface. The column may be provided with a plurality of detent positions for suspending the tray at various heights above the floor. The tray may be raised to an out-of-the-way position by fully collapsing the column. A cover may be provided to cover the tray when the column is fully collapsed. A positive-acting latch is conveniently operated from the underside of the tray to lower the tray when desired.

8 Claims, 5 Drawing Figures

COLLAPSIBLE COLUMN WITH COVERED TRAY

BACKGROUND OF THE INVENTION

The present invention relates to holders for articles whose height above a floor or other surface may be varied as desired, and more particularly to a tray which may be suspended from a ceiling by means of a collapsible column.

Ceiling-suspended devices of varying types are known in the prior art. For example, U.S. Pat. No. 3,711,021 to Tantillo discloses a holder for articles which may be suspended from a ceiling by means of a telescoping rod assembly such as a collapsible column. However, the sliding column members of Tantillo are only frictionally engaged, so that the holder supports very little weight if the column is not fully extended. A similar device, but including a counterweight, is illustrated in U.S. Pat. No. 675,861 to Marquart. Another ceiling-suspended tray, but lacking easy adjustability in height due to the use of a set screw to maintain the relative positions of the telescoping rods, is illustrated in U.S. Pat. No. 2,830,707 to Schmidt et al. A similar lack of easy longitudinal adjustability is found in U.S. Pat. No. 3,033,628 to Hoffman, wherein a series of locking nuts must be manipulated to adjust the telescoping rods.

Latch mechanisms of varying kinds are also illustrated in the prior art, but lack the convenience and ease of operation of the latch mechanism incorporated into the present invention. For example, U.S. Pat. No. 3,804,355 to Uroshevich illustrates a collapsible stand which is suitable only for very light objects and which is adjustable only by means of a spring-loaded pin mounted in the side of the column. Such a design would be unsuitable for a ceiling-mounted tray due to inaccessability of the pin. Similarly, U.S. Pat. No. 2,016,132 illustrates an elaborate and prohibitively expensive latch mechanism for raising and lowering a stool, having an external handle for engaging a latch in a recess located internal to a telescoping column.

SUMMARY OF THE INVENTION

According to the present invention there is provided a collapsible column with covered tray which is adapted to be suspended from a ceiling, and wherein the height of the tray above the floor or other surface is easily and conveniently adjusted by a latch mechanism operated from the underside of the tray. The locking operation of the latch mechanism provides positive control of the height of the tray and affords the ability for the tray to support a considerable amount of weight.

Accordingly, it is an object of the present invention to provide a tray which may be suspended from a ceiling and lowered conveniently when it is desired to utilize the contents of the tray.

It is another object of the present invention to provide such a tray wherein the height of the tray is adjustable in discrete increments by means of a positive-acting latch mechanism operated from the underside of the tray.

It is a further object of the present invention to provide a cover for such a tray when the tray is in its fully raised position.

These and other objects and advantages of the present invention will become apparent from the following detailed description, taken in conjunction with the accompanying drawings.

DETAILED DESCRIPTION OF THE PREFERRED EMBODIMENT

Figure 1:
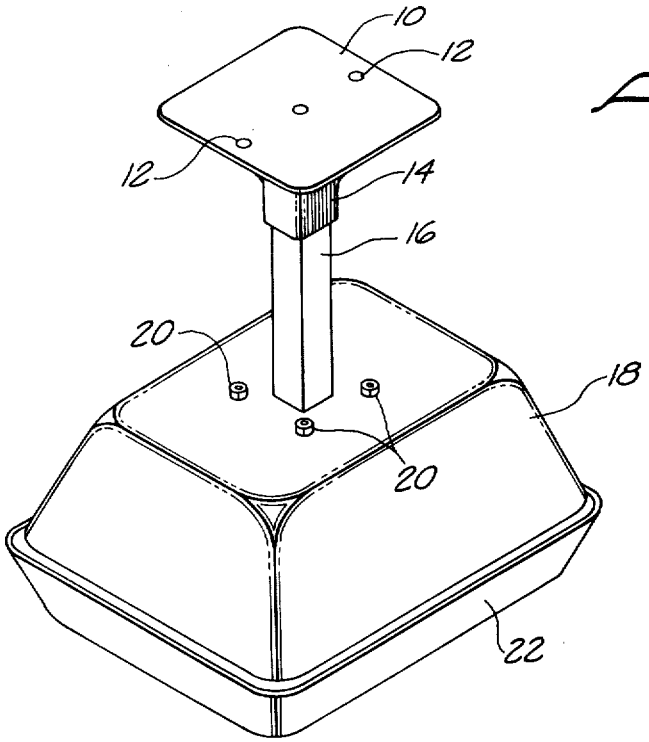
FIG. 1 is a perspective view of a column and tray according to the present invention, wherein the column is completely collapsed and the tray is covered.

Referring to the drawings, and first to FIG. 1 thereof, there is illustrated a collapsible column with covered tray according to the present invention. The device is illustrated for use in its preferred environment, that is, for suspension from a ceiling or similar structure. A mounting bracket 10 is provided with cylindrical apertures 12 for receiving mounting bolts or screws (not shown) by which the bracket 10 may be mounted upon a support structure. The lower portion of the bracket 10 is shaped as a sleeve 14, preferably of rectangular cross-section. Received within the sleeve 14 and connected thereto is a fixed hollow column portion 16 of a collapsible column, the remainder of which will be described in greater detail hereinafter. A cover 18 is supported in a fixed position with respect to the column portion 16, in a manner to be described in greater detail hereinafter, by fasteners 20 such as nut and bolt assemblies. Below the cover 18, and connected to the collapsible column in a manner to be described in greater detail hereinafter, is a tray 22. The cover 18 and tray 22 may be of any desired size and shape, and are preferably fabricated of molded plastic.

Figure 2:
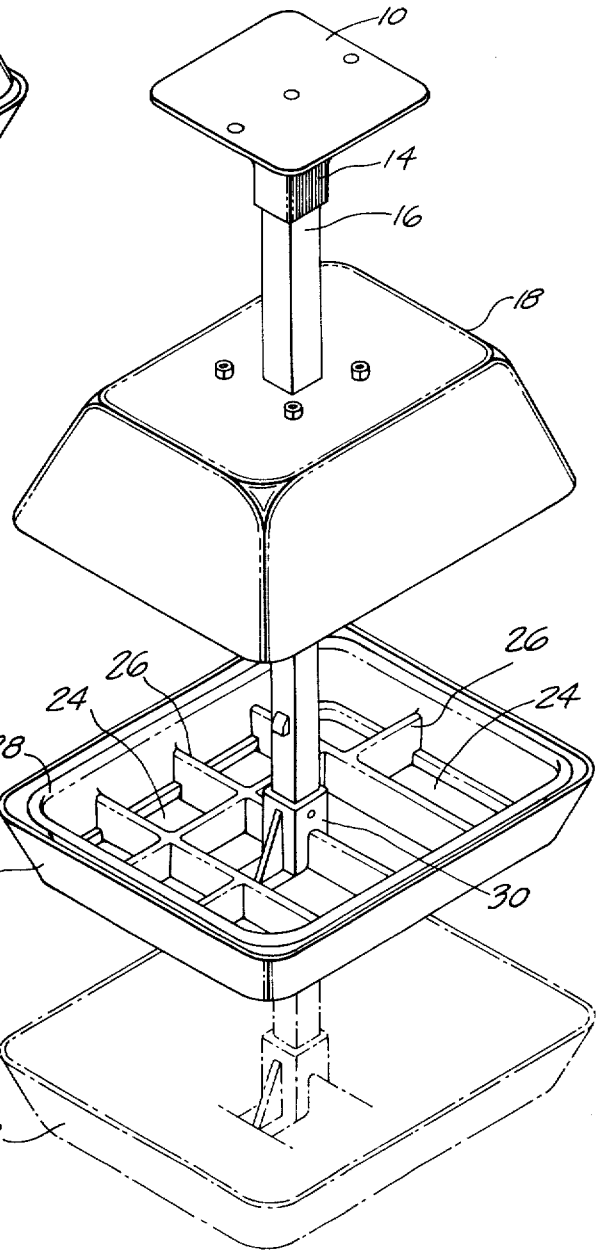
FIG. 2 is a perspective view as in FIG. 1, illustrating in full lines the tray lowered to a first detent position, and in broken lines the tray lowered to a second detent position in which the column is fully extended.

Referring next to FIG. 2, the tray 22 is illustrated in full lines in a partially lowered configuration. In broken lines, there is illustrated a fully lowered position of the tray 22. It will be understood that although the preferred embodiment described herein utilizes two open detent positions of the tray for purposes of illustration, in addition to the closed position, modifications to the collapsible column which would provide for a greater number of intermediate positions of the tray in accordance with the present invention would be apparent to those skilled in the art.

FIG. 2 also illustrates a typical internal configuration for the tray 22, comprising a plurality of compartments 24 created by partitions 26. As depicted in FIG. 2, the compartments 24 and partitions 26 are molded in an inner tray 28 which is mounted within the tray 22. It will be apparent, however, that the inner tray 28 need not be used, and that the partitions 26 and resulting compartments 24 may be formed directly in the tray 22. Also, it will be noted that the partitions 26 and compartments 24 can be arranged in any suitable size, shape and form, depending upon the purpose for which the tray will be utilized. In the center of the tray 22 there is provided a sleeve 30 of rectangular cross-section, for receiving the lower portion of the collapsible column in a manner to be described in greater detail hereinafter.

Figure 3:
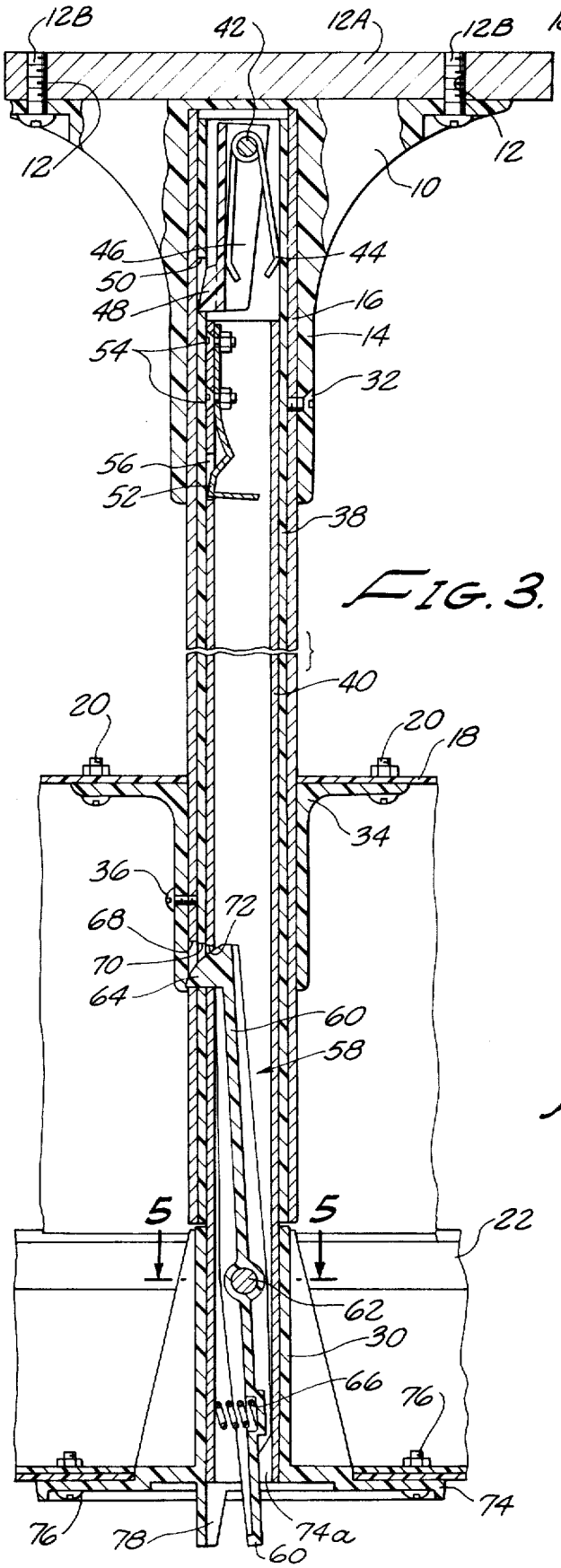
FIG. 3 is a side sectional view taken through the column of the present invention when the column is completely collapsed as in FIG. 1.

Referring next to FIG. 3, there is illustrated a cross-sectional view of the collapsible column of the present invention in a fully collapsed configuration, as it would be mounted upon a ceiling or other mounting surface 12*a* by means of fasteners 12*b* passing through the apertures 12 in the bracket 10. As described previously, the fixed hollow column portion 16 of the collapsible column is received within the sleeve 14 of the bracket 10, and is securely attached thereto by fastener means such as a screw 32. The manner of attachment of the cover 18 to the fixed column portion 16 is also illustrated, and comprises a sleeve 34 fastened to the underside of the cover 18 by the fasteners 20 and attached to the column portion 16 by a screw 36.

As further illustrated in FIG. 3, there is slidably received within the fixed hollow column portion 16 a first movable hollow column portion 38, and slidably received within the column portion 38 is a second movable hollow column portion 40. While the three-part collapsible column illustrated herein represents a preferred embodiment of the present invention, collapsible columns comprising any number of hollow column portions may be utilized as desired. Near the upper end of the movable column portion 38, and supported thereby, there is provided a shaft 42 around which is wound a spring 44, and upon which is mounted a locking mechanism 46 having a latch 48 received within an aperture 50 of the column portion 38. The spring 44 urges the latch 48 against the inner surface of the fixed hollow column portion 16 through the aperture 50.

Near the upper end of the movable column portion 40 there is provided a latch 52, which may be made of spring steel and which is affixed to the inner surface of the column portion 40 by means of fasteners 54 such that the latch 52 is held in tension against the inner surface of the hollow column portion 38 through an aperture 56 in the hollow column portion 40.

Near the lower end of the movable column portion 40 is a locking mechanism designated generally as 58 and including a bar 60 pivoted about a shaft 62 and having a latch 64 at the upper end thereof. Near the end of the bar 60 opposite the latch 64, there is provided a spring 66 which maintains tension between the bar 60 and the inner surface of the movable column portion 40. This tension forces the latch 64 through coincident apertures 68, 70 and 72 in the column portions 16, 38 and 40 respectively. This arrangement maintains the collapsible column in a closed configuration. Also illustrated is a plate 74 connected to the underside of the tray 22 by fasteners 76, and including a tab 78 for convenient operation of the locking mechanism 58, as will be explained in greater detail hereinafter. The plate 74 may be integral with the sleeve 30 as illustrated, and includes an aperture 74*a* through which the lower end of the bar 60 protrudes.

Figure 4:
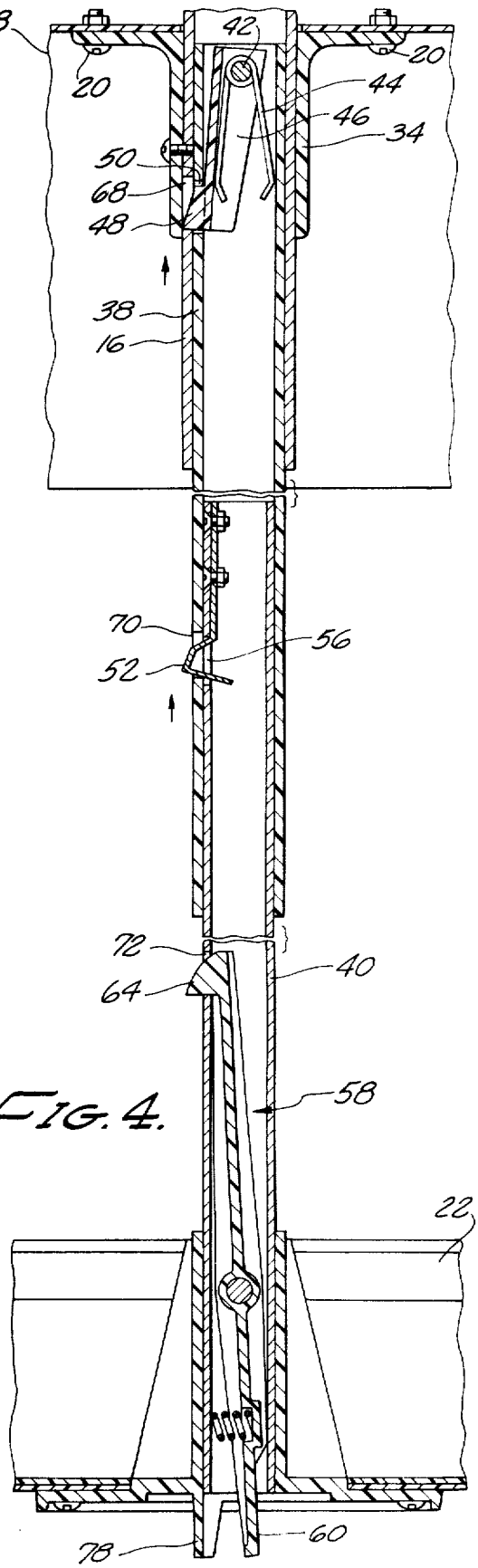
FIG. 4 is a sectional view of the column as in FIG. 3, illustrating the column and the latch mechanism contained therein when the column is fully extended as shown in broken lines in FIG. 2.

Referring next to FIG. 4, the collapsible column of the present invention is illustrated in its fully extended configuration, and the operations by which this configuration is achieved will now be briefly discussed.

By squeezing the tab 78 and the lower end of the bar 60 between the thumb and forefinger, the latch 64 of the latching mechanism 58 is disengaged from the coincident apertures 68, 70 and 72 respectively, allowing the movable column portion 38 to slide downward within the fixed column portion 16. A point will be reached at which the aperture 50 near the upper end of the movable column portion 38 becomes coincident with the aperture 68 near the lower end of the fixed column portion 16. At this point, the latch 48 of the locking mechanism 46 is forced by the spring 44 through both coincident apertures 50 and 68, causing the latch 48 to lock the movable column portion 38 with respect to the fixed column portion 16. Consequently, the tray 22 is locked into the partially lowered position illustrated in full lines in FIG. 2. It will be understood that at the same time, the latch 64 of the locking mechanism 58, having been released by the operator, becomes re-engaged with the coincident apertures 70 and 72 of the movable column portions 38 and 40 respectively, so that the movable column portion 40 remains fully received within the movable column portion 38. It may be desirable, in order to achieve the foregoing function, to construct the portions of the collapsible column such that the frictional forces between the movable column portion 40 and the movable column portion 38 are greater than the frictional forces between the movable column portion 38 and the fixed column portion 16.

A further extension of the collapsible column may be effected by again squeezing the lower end of the bar 60 and the tab 78, thus disengaging the latch 64 from the coincident apertures 70 and 72. The movable column portion 40 is then allowed to slide downward within the movable column portion 38, to a point at which the aperture 56 near the upper end of the movable column portion 40 becomes coincident with the aperture 70 in the movable column portion 38. At this point, the latch 52 is forced through the coincident apertures 56 and 70 to lock the movable column portion 40 in a fixed position with respect to the movable column portion 38. In this position the collapsible column is fully extended, as illustrated in FIG. 4 and in broken lines in FIG. 2.

Figure 5:
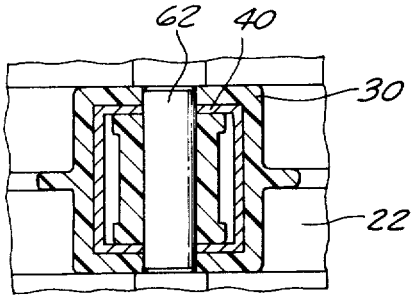
FIG. 5 is a sectional view along the line 5—5 of FIG. 3, illustrating in greater detail the pivot portion of the latch mechanism operated from the underside of the tray.

In FIG. 5, a top cross-sectional view taken along the line 5—5 of FIG. 3, the shaft 62 of the locking mechanism 58 is illustrated in more detail. In particular, FIG. 5 illustrates that the shaft 62 extends through the movable column portion 40 and is supported by the sleeve 30 extending upwardly from the tray 22.

Closure of the collapsible column and tray is accomplished simply by pushing upward on the bottom of the tray 22, causing each of the latches 48, 56 and 64 to disengage from the apertures in which they were formerly engaged by the action of the surrounding hollow column portion on the downwardly sloping upper surface of each of the respective latches. That is, upward pressure on the tray 22 causes the movable column portion 38 to slide into the fixed column portion 16. The pressure of the upper edge of the aperture 68 against the sloping surface of the latch 48 causes the latch 48 to disengage from the aperture 68. When the movable column portion 38 is fully received within the fixed column portion 16, the movable column portion 40 begins to slide into the movable column portion 38. The pressure of the upper edge of the aperture 70 against the sloping surface of the latch 52 causes the latch 52 to disengage from the aperture 70. Likewise, upward pressure forces the latch 64 of the locking mechanism 58 inward upon encountering the lower edges of the column portions 16 and 38. When the position is reached at which the apertures 68, 70 and 72 are again coincident, the expansive force of the spring 66 on the bar 60 will cause the latch 64 to become engaged with these coincident apertures, locking the column in a closed position as in FIG. 3.

While the present invention has been illustrated and described with respect to a preferred embodiment thereof, variations will be apparent to those skilled in the art without departing from the spirit of the invention, and it is intended that all such variations be encompassed within the scope of the appended claims.

I claim:

1. Apparatus for holding articles comprising means for mounting said apparatus on a supporting surface, a collapsible column connected to said mounting means and comprising a fixed hollow column portion and a plurality of movable hollow column portions adapted to be telescopically received therein, a tray connected to said collapsible column and adapted to be adjustable in position with respect to said supporting surface by the telescoping action of said collapsible column, and locking means for adjusting the length of said collapsible column at a plurality of predetermined distances, said locking means comprising a first spring-loaded latch housed within said collapsible column and being adapted for engagement with a first plurality of aligned apertures in the hollow column portions of said collapsible column, and a second spring-loaded latch housed within said collapsible column and being adapted for engagement with a second plurality of aligned apertures in the hollow column portions of said collapsible column.

2. Apparatus for holding articles comprising a support bracket adapted for mounting said apparatus on a ceiling, a collapsible column connected to said support bracket and having telescoping portions, a tray connected to said collapsible column and adapted to be adjustable in height by the telescoping action of said collapsible column, and means for locking the position of said tray at one of a plurality of predetermined distances from the ceiling, comprising a spring-loaded latch mechanism housed within said collapsible column and having a first latch adapted for engagement with a first plurality of aligned apertures in at least some of the telescoping portions of said collapsible column, and a spring-biased bar housed within said collapsible column upon an axis shaft and having a second latch at one end thereof adapted to engage a second plurality of aligned apertures in at least some of the telescoping portions of said collapsible column, the other end of said spring-biased bar protruding from the underside of said tray and adapted to be rotated about said axis shaft for disengagement of said latch from said second plurality of aligned apertures.

3. Apparatus for holding articles comprising a support bracket adapted to be mounted to a ceiling, a collapsible column connected to said support bracket and having telescoping portions, a tray connected to said collapsible column, and means for adjusting the height of said tray in discrete increments, comprising a first latch mechanism housed within the collapsible column and operable from the underside of said tray, said first latch mechanism including a spring-biased pivoted bar having a latch at one end thereof adapted for engagement with a first plurality of aligned apertures in at least some of said telescoping portions of said collapsible column, and means for locking said collapsible column in a fully extended configuration, comprising a second latch mechanism housed within said collapsible column and including a spring-loaded latch adapted for engagement with a second plurality of aligned apertures in at least some of said telescoping portions of said collapsible column when said collapsible column is fully extended.

4. A ceiling mounted adjustable height tray comprising a mounting bracket adapted to be mounted to a ceiling, a fixed hollow column portion connected to said mounting bracket and having an aperture in one side thereof, a first movable hollow column portion adapted to be slidably received within said fixed hollow column portion and having a pair of longitudinally separated apertures in one side thereof and a spring biased latch engaging the upper of said apertures, a second movable hollow column portion adapted to be slidably received within said first movable hollow column portion and having a pair of longitudinally separated apertures in one side thereof and a spring biased latch engaging the upper of said apertures, a tray connected to said second movable hollow column portion, and a latch mechanism housed within said second movable hollow column portion and comprising a spring biased, pivoted bar having one end protruding from the underside of said tray and having a latch on the other end adapted to engage the lower of said apertures in said second movable hollow column portion, the respective apertures in said hollow column portions being located so that at least some of said apertures are coincident in preselected positions of said hollow column portions for engagement of a preselected one of said latches with said coincident apertures.

5. Apparatus as in claims 1, 2 or 3 further comprising a cover mounted upon said collapsible column and adapted to cover said tray when said column is fully collapsed.

6. A tray according to claim 4 further comprising a cover supported by said fixed hollow column portion and adapted to cover said tray when said movable hollow column portions are fully received within said fixed hollow column portion.

7. Apparatus as in claim 1, 2, 3 or 4 wherein said tray is divided into a plurality of compartments for holding articles separately.

8. A ceiling mounted adjustable height tray comprising a mounting bracket adapted to be mounted to a a ceiling, a collapsible column comprising a fixed hollow column portion and first and second movable hollow column portions, said fixed hollow column portion being connected to said mounting bracket and having an aperture in one side thereof, said first movable hollow column portion being adapted to be slidably received within said fixed hollow column portion and having a pair of longitudinally separated apertures in one side thereof and a first spring biased latch engaging the upper of said apertures, and said second movable hollow column portion being adapted to be slidably received within said first movable hollow column portion and having a pair of longitudinally separatered apertures in one side thereof and a second spring biased latch engaging the upper of said apertures, a tray connected to said second movable hollow column portion and being divided into a plurality of compartments for holding articles separately, a cover supported by said fixed hollow column portion and adapted to cover said tray when said collapsible column is fully collapsed, and a latch mechanism housed within said second movable hollow column portion and comprising a spring biased, pivoted bar having one end protruding from the underside of said tray and having a third latch on the other end adapted to engage the lower of said apertures in said second movable hollow column portion and to disengage therefrom when said bar is pivoted, the respective apertures in said hollow column portions being located such that said collapsible column may be maintained in a fully collapsed configuration by the engagement of said third latch with said aperture in said fixed hollow column portion and the lower of said apertures in said first and second movable hollow column portions, may be maintained in a partially extended configuration by the simultaneous engagement of said first latch with said aperture in said fixed hollow column portion and the upper of said apertures in said first movable hollow column portion and said third latch with the lower of said apertures in said first and second movable hollow column portions, and may be maintained in a fully extended configuration by the simultaneous engagement of said first latch with said aperture in said fixed hollow column portion and the upper of said apertures in said first movable hollow column portion and said second latch with the lower of said apertures in said first movable hollow column portion and the upper of said apertures in said second movable hollow column portion.

* * * * *